United States Patent [19]

Löbbe et al.

[11] 4,180,291

[45] Dec. 25, 1979

[54] MINERAL MINING INSTALLATION

[75] Inventors: Armin Löbbe, Lünen; Hans-Jürgen Penzek, Oberaden, both of Fed. Rep. of Germany

[73] Assignee: Gewerkschaft Eisenhutte Westfalia, Fed. Rep. of Germany

[21] Appl. No.: 859,483

[22] Filed: Dec. 12, 1977

[30] Foreign Application Priority Data

Dec. 15, 1976 [DE] Fed. Rep. of Germany ..... 2656792

[51] Int. Cl.[2] ..... E21C 27/32

[52] U.S. Cl. ..... 299/34; 299/43; 299/88

[58] Field of Search ..... 299/32, 34, 42–46, 299/80, 88

[56] References Cited

U.S. PATENT DOCUMENTS

| | | | |
|---|---|---|---|
| 54,833 | 5/1866 | Locke et al. | 299/42 X |
| 137,669 | 4/1873 | Firth | 299/42 |
| 550,895 | 12/1895 | McKinlay | 299/42 |
| 993,474 | 5/1911 | Thomas | 299/42 |

FOREIGN PATENT DOCUMENTS

| | | | |
|---|---|---|---|
| 1164954 | 3/1964 | Fed. Rep. of Germany | 299/43 |
| 932455 | 7/1963 | United Kingdom | 299/34 |

*Primary Examiner*—Ernest R. Purser
*Assistant Examiner*—Nick A. Nichols Jr.
*Attorney, Agent, or Firm*—Thompson, Birch, Gauthier & Samuels

[57] ABSTRACT

A mineral mining installation for winning material in a "stable-hole" region of a longwall face comprises a guide and a base slidably mounted on the guide. At least one tool carrier is pivotally mounted on the base and drive means are provided for reciprocating the base along the guide. Control means are provided for pivoting each carrier between an operating position and a non-operating position, the control means being such that a working stroke of the drive means initially pivots each carrier from its non-operating position to its operating position and then causes the base and carrier(s) to execute a working stroke along the guide. The control means is also such that a return stroke of the drive means initially causes each carrier to pivot from its operating position to its non-operating position, and then causes the base and carrier(s) to execute a return stroke along the guide.

24 Claims, 3 Drawing Figures

MINERAL MINING INSTALLATION

BACKGROUND TO THE INVENTION

This invention relates to a mineral mining installation and in particular to an installation for winning material in the "stable-hole" regions at the two ends of a longwall face.

Winning of coal from a longwall face adjoining a roadway gallery has always been difficult since the known type of coal plough which is guided on a longwall conveyor can only remove coal between the two end drive stations of the conveyor. The portions of the longwall face which accommodate the drive stations (that is to say the so-called "stable-hole" regions) must, therefore, either be won by hand or by auxiliary winning machines. Moreover, as these drive stations are heavy and bulky the "stable-hole" regions must necessarily be won as a preliminary operation before the main portion of the face can be won.

One known type of winning machine for these "stable-hole" regions is an auxiliary plough which is driven from the main plough via push rods. The disadvantage of such an arrangement is that the main plough must be stationary during operation of the auxiliary plough, and so the main mining operation is interrupted each time the "stable-hole" regions need to be excavated further prior to the conveyor (and drive stations) being advanced to a position in which a newly exposed portion of the longwall face can be cut. This inevitably results in a reduction in the productivity of such an arrangement.

Another known type of auxiliary plough utilises its own drive unit. This plough is a combined cutter and loader having cutters alternating with ramp sections which function as loading devices for the cut coal. The plough is reciprocated along a guide by a double-acting ram. Unfortunately, this arrangement is costly and has a large overall width. Moreover, the interposition of the ramp sections between the cutters gives rise to problems. Furthermore, this type of plough cannot be used to cut out the "stable-hole" regions as a preliminary operation to the main cutting operation of the longwall face.

It is the aim of the invention to provide a plough for winning material in the "stable-hole" regions of a longwall face, which plough has its own drive units, is comparatively simple and sturdy and which has a comparatively small overall width.

SUMMARY OF THE INVENTION

The present invention provides a mineral mining installation for winning material in a "stable-hole" region of a longwall face, the installation comprising a guide, a base slidably mounted on the guide, at least one tool carrier pivotally mounted on the base, drive means for reciprocating the base along the guide, and control means for pivoting the or each carrier between an operating position and a non-operating position, wherein the control means is such that a working stroke of the drive means initially pivots the or each carrier from its non-operating position to its operating position and then causes the base and carrier(s) to execute a working stroke along the guide, and a return stroke of the drive means initially causes the or each carrier to pivot from its operating position to its non-operating position and then causes the base and carrier(s) to execute a return stroke along the guide.

Preferably, a double-acting hydraulic ram constitutes the drive means, and advantageously, there are a plurality of carriers which are coupled together for conjoint pivotal movement between their operating and non-operating positions. In this way, the end face in the "stable-hole" region can be worked by several tool carriers arranged in echelon formation one behind the other and driven by a common ram whose working stroke is approximately equal to the spacing between the carrier, or is somewhat larger than this distance.

The installation may further comprise a retarding device for retarding the pivotal movement of the or each carrier from its operating position to its non-operating position at the start of each return stroke. Preferably, a hydraulic damping ram, interposed between the base and the or a carrier, constitutes the retarding device.

The control means may incorporate a lost-motion device or linkage between the drive means and the base. Preferably, the lost-motion device is constituted by an actuating lever movable with the drive means and stop means associated with the base, the device being such that the initial movement of the drive means in either direction causes pivoting of the or each carrier, and, when the actuating lever bears against said stop means, further movement of the drive means carries the base and carrier(s) therewith.

A pair of axially spaced stop faces may constitute said stop means, the actuating lever being movable between said stop faces. In this case, where there are three carriers linked together, the actuating lever forms an extension of the central carrier.

Alternatively, said stop faces may be constituted by the ends of an elongate slot formed in a bracket carrier by the base, and said actuating lever is constituted by a bolt carried by a bracket movable with the drive means. In this case, the installation may further comprise a rod fixed to the actuating lever, the rod constituting the means for pivoting the or each carrier, a respective aperture being provided in the rod for each carrier, a lever fixed to that carrier extending into that aperture for transmitting rectilinear motion of the rod into pivotal motion of that carrier.

In another embodiment the or each carrier is provided with a lever drivably connected to the drive means, the or each carrier defining two stop faces which co-operate with a respective stop member on the base to constitute the lost motion device, the device being such that the initial movement of the drive means in either direction causes pivoting of the or each carrier, and, when the or each carrier has been pivoted from a position in which one of its stop faces bears against the corresponding base stop member to a position in which the other of its stopfaces bears against said stop member, further movement of the drive means carries the base and carrier(s) therewith.

Advantageously, the guide is provided with a curved extension along which an additional tool carrier is movable, the additional tool carrier being drivably linked to the base. Preferably, the extension curves through an angle of approximately 90°. This permits the installation to be used to form an initial clearance in the "stable-hole" region prior to the winning of material from the longwall face itself. This initial clearance is also aided by ensuring that the installation is movably relative to the drive frame of the longwall conveyor drive station to which it is mounted.

BRIEF DESCRIPTION OF THE DRAWINGS

The invention will now be described in greater detail, by way of example, with reference to the accompanying drawings, in which.

DESCRIPTION OF PREFERRED EMBODIMENT

Figure 1:
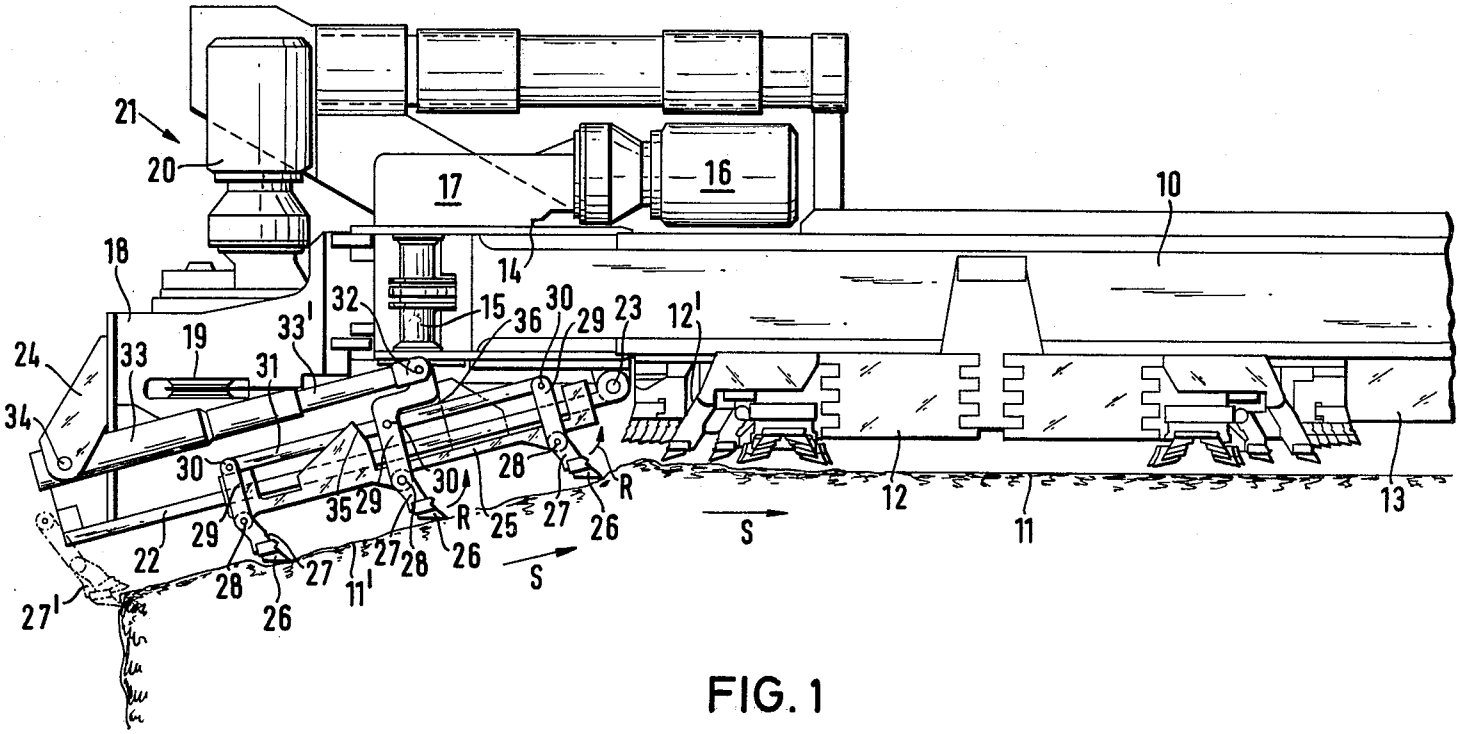
FIG. 1 is a plan view of an auxiliary plough constructed in accordance with the invention.

Referring to the drawings, FIG. 1 shows one end of a longwall mineral mining installation constituted by a scraper-chain conveyor 10 positioned in front of the actual longwall face 11 and a plough 12 which is movable along the conveyor on a guide 13 provided on the working face side of the conveyor. The plough is moved in a manner known per se by means of a chain (not shown) which runs in channels (not shown) in the guide 13.

As is conventional, a drive station is provided at each end of the conveyor 10, only one of these stations (the auxiliary drive station) being shown in FIG. 1. A chain drum 15 for driving the scraper-chain assembly or assemblies is mounted within a drive frame 14 of the auxiliary drive station, the chain drum being driven by a motor 16 via a gear unit 17 attached to the goaf side plate of the drive frame. The end face of the drive frame 14 is provided with a frame 18 in which is mounted a sprocket wheel 19 for driving the plough 12 via its chain. The sprocket wheel 19 is driven by a separate motor and gear box arrangement 20 which is attached to the frame 18 on the goaf side.

FIG. 1 shows the plough 12 at the end of its cutting run and in the position in which the direction of its drive is being reversed so that the plough will then move back along the longwall face 11 in the direction of the arrow S. Thus, the plough 12 can only work the coal face 11 up to a point situated approximately immediately in front of the drive frame 14. The entire auxiliary drive station constituted by the drive frame 14 and its associated drive units 16, 17 and 20 lies in the "stable-hole" 21 which is cleared by means of an auxiliary plough having a guide bar 22 one end of which is pivotally connected to the drive frame 14 by means of a pivot joint 23 whose axis is substantially vertical. The other end of the guide bar 22 is connected to the frame 18 by means of a bracket 24. The guide bar 22 is thus connected to the drive frame 14 in such a manner that it can be positioned at different angles to the longitudinal axis of the conveyor 10 and so that it has a limited degree of play in the seam plane.

The auxiliary plough comprises a narrow plough base 25 to which three carriers 27 are pivoted about vertical pivot pins 28, each carrier being provided with a plurality of cutters 26 mounted in echelon formation. Each carrier 27 has a lever 29 secured thereto for conjoint rotation about the respective pivot pin 28, the rear ends of the lever 29 each being pivotally connected at 30 to a push rod 31. The lever 24 associated with the central carrier 27 is constructed (see FIG. 1) with an L-shaped extension, the free end of which is pivotally connected, at 32, to the piston rod 33' of a multi-cylinder, double-acting hydraulic ram 33. The ram 33 is pivotally connected, at 34, to the bracket 24, and the length of its working stroke is arranged to be greater than the spacing between the carriers 27. The plough base 25 is formed with a pair of stops 35 and 36 positioned one on each side of the lever 29 associated with the central carrier 27.

Assuming the carriers 27 of the auxiliary plough are in the positions shown in FIG. 1, and the ram 33 is fully extended, operation is as follows. In the position shown, the plough has just completed a cut in the direction of arrow S'. If now the ram 33 is retracted, it carries with it the push rod 31 through the interaction of the lever 29 of the central carrier 27. The push rod 31 thus moves in direction opposite to that of the arrow S' and so pivots all of the carrier 27 about their pivot axes 28 in the direction of the arrows R. The cutters 26 are, accordingly, moved away from the face 11' in the "stable-hole" region. When the carriers 27 are fully pivoted away from the face 11' the L-shaped extension of the central lever 29 rests against the stop 35 so that further retraction of the ram 33 causes all three carriers 27 to be moved, together with the push rod 31, along the guide bar 22 in a direction opposite to that of the arrow S'. When the ram 33 is fully retracted, the rear (left-hand as seen in FIG. 1) carrier 27 is in the position shown in dot-dash lines. If the ram 33 is now extended, the carriers 27 are first pivoted back towards the face 11', so as to occupy their cutting positions, by their interaction with the central lever 29 and the push rod 31. When the carriers 27 are in their cutting positions, the central lever 29 rests against the stop 36 so that further extension of the ram 33 causes the carriers 27 to move with the push rod 31 in the direction of the arrow S'. During this movement, the cutters 26 of the carriers 27 detach coal from the face 11', this detached coal at the same time being conveyed by the auxiliary plough towards the conveyor 10. If the main plough 12 is located in the position shown in FIG. 1, this coal detached by the auxiliary plough is loaded onto the conveyor 10 via the plough-share like faces 12' of the main plough. Consequently, if the main plough 12 is at the end of its run, it co-operates with the auxiliary plough to load the coal won from the "stablehole" region onto the conveyor 10. If, on the other hand, the main plough 12 is in the course of a coal-winning run along the longwall face 11, the coal detached by the auxiliary plough is deposited in the track of the main plough. Part of this coal is guided onto the conveyor 10 by the guide 13 and the rest is loaded by the main plough 12 next time it reaches the end of its run.

Figure 2:
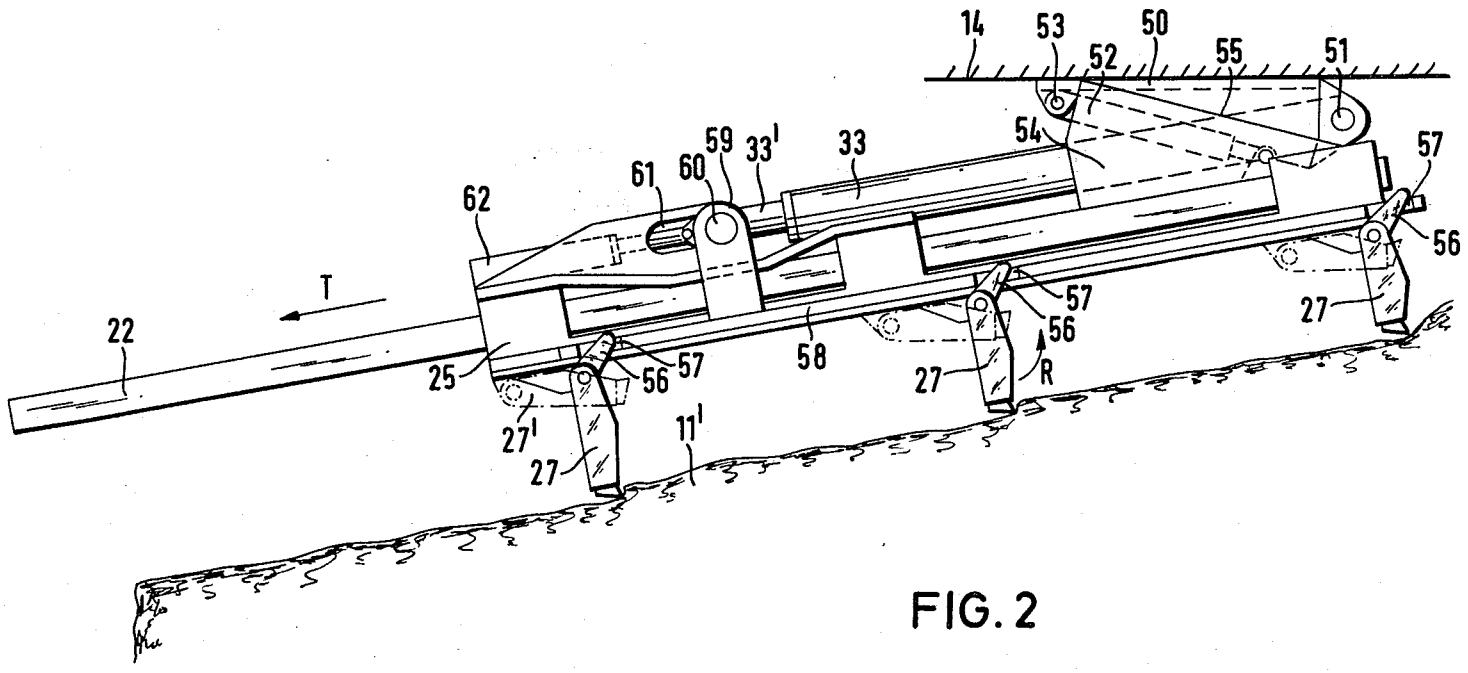
FIGS. 2 and 3 are plan views of modified versions of the plough of FIG. 1.

FIG. 2 shows a modified form of auxiliary plough having a bracket 50 connected to the drive frame 14, the bracket 50 forming an abutment for the ram 33 which is pivotally connected thereto by means of a pivot joint 51. A further hydraulic ram 52 is also pivotally connected to the bracket 50 at a pivot joint 53, the piston rod of this ram being pivotally connected to a bracket 54 which is fixed to the face side end of the guide bar 22. The bracket 54 is slidably mounted on guide surfaces 55 which extend at an acute angle to the longitudinal axis of the conveyor 10. The ram 52 can, therefore, move the guide bar 22 to and fro in a direction parallel to that of the face 11'.

As with the embodiment of FIG. 1, the auxiliary plough of FIG. 2 has three carriers 27 mounted on a narrow plough base 25. Here, however, the carriers 27 are pivoted into, and out of, their working positions by means of levers 56 fixed thereto and extending into recesses 57 of a push rod 58. A bracket 59 is fixed to the push rod 58, and the piston rod 33' of the ram 33 is connected to this bracket 59 by means of a bolt 60. The bolt 60 also passes through an elongate hole 61 formed in the plough base 25, the longitudinal axis of this elongate hole extending in the direction of the axis of the ram 33. The piston rod of a hydraulic damping ram 62 is connected to the plate 59 (or to the bolt 60), the ram 62 being supported on the plough base 25.

Assuming the auxiliary plough has just completed a working run along the face 11', the carriers 27 will be in the positions shown in FIG. 2, and the ram 33 will be fully retracted. If now the ram 33 is extended, the bracket 59 is carried by the piston rod 33' in the direction of the arrow T. Since the bracket 59 is supported on the plough base 25 via the hydraulic damping ram 62, the initial movement of the bracket 59 is not communicated to the plough base (and hence not to the carriers 27). The damping ram 62, which is provided with an adjustable throttle, is, however, retracted and the push rod 58 is displaced in the direction of the arrow T relative to the plough base 25. This movement of the push rod 58, owing to the interaction of its recesses 57 with the lever 56, causes the carrier 27 to pivot in the direction of the arrow R out of their working positions so as to occupy the positions shown at 27' in dot-dash lines. When the ram 62 is fully retracted, the bolt 60 bears against the left-hand end of the elongate hole 61 so that further extension of the ram 33 causes the plough base 25 and the retracted carriers 27 to move in the direction of the arrow T.

At the end of the return stroke, the ram 33 is retracted so that initially the carriers 27 are pivoted back into their working positions by the interactions of the push rod 58 with the levers 56. Further movement of the bracket 59 with the piston rod 33' brings the bolt 60 to bear against the right-hand end of the elongate hole 61. Yet further movement carries the plough base 25 and carriers 27 so that the cutters of the latter detach coal from the face 11' and transport into the track of the main plough as described in connection with FIG. 1. It should be noted that the damping ram 62 leads to a retardation of the automatic retraction of the carriers 27 at the start of the return stroke of the auxiliary plough. This is advantageous in that it ensures that the carriers 27 are reliably disengaged from the face 11'. Another advantage is that the coal to be conveyed and which lies in front of the face 11' does not obstruct the retraction of the carriers 27.

Figure 3:
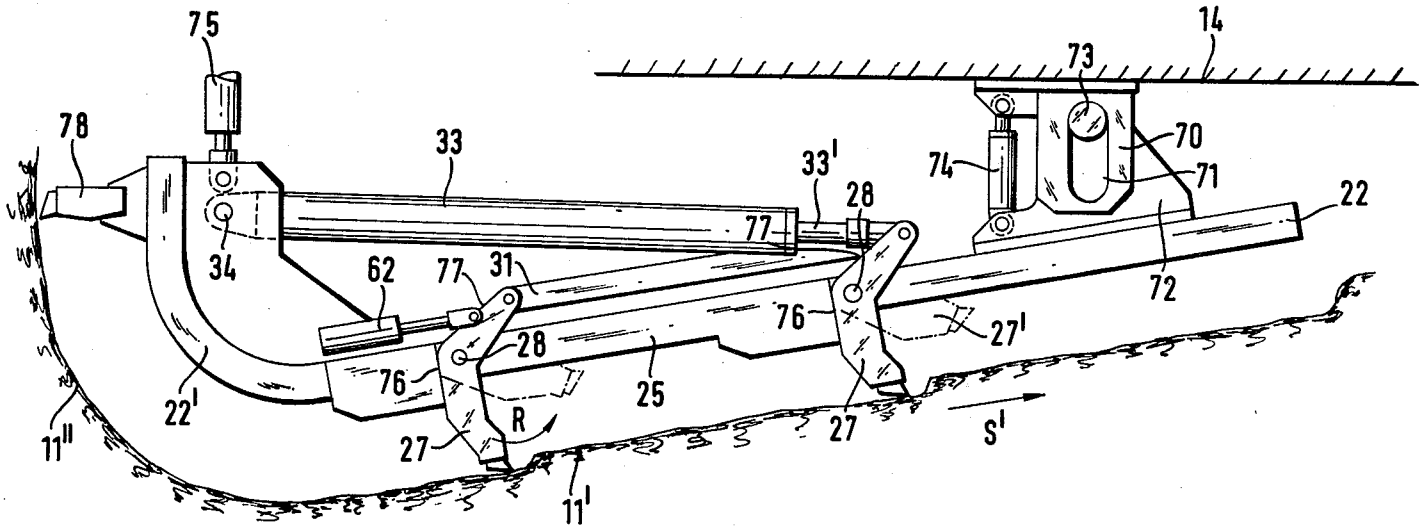

FIG. 3 shows another modified form of auxiliary plough which is connected to the drive frame 14 by means of a bracket 70. An elongate hole 71, whose axis is at right-angles to the longitudinal axis of the drive frame 14, is provided in the bracket 70. A bracket 72 fastened to the guide bar 22 is provided with a bolt 73 which passes through the elongate hole 71. A pair of hydraulic rams 74 and 75 are provided for advancing the auxiliary plough towards the face 11', the ends of the elongate hole 71 constituting stops limiting this movement.

The plough base 25 is provided with two carriers 27, each of which is pivotable about a respective pivot joint 28. Each carrier 27 is constituted by a two-armed lever, the rear rams of these levers being pivotally connected by means of a push rod 31. The piston rod 33' of the ram 33 is pivotally connected to the rear arm of the front carrier 27, the ram itself being pivotally connected, at 34, to a curved extension 22' of the guide bar 22. A damping ram 62 is mounted on the plough base 25, the piston rod of this damping ram being pivotally connected to the rear arm of the back carrier 27. This damping ram 62 has the same function as that described above in connection with FIG. 2.

This form of auxiliary plough operates in a similar manner to those already described. Thus, at the start of the working stroke, the carriers 27 are pivoted into their working positions, at which stage they bear against stops 76 provided on the plough base 25. Further extension of the piston rod 33' of the ram 33 carries the plough base 25 and the carriers 27 in the direction of the arrow S', whereby the cutters of the carrier detach coal from the face 11'. On retraction of the ram 33, the carriers 27 are initially swung back, against the resistance of the damping ram 62, in the direction of the arrows R until they occupy the positions shown at 27' in dot-dash lines. In this position, the stop faces 77 of the carriers 27 bear against the stops 26 on the plough base 25 so that, on further retraction of the piston rod 33', the plough base 25 and the carriers 27 are moved back in a direction opposite to that of the arrow S'.

As can be seen in FIG. 3, the extension 22' of the guide bar 22 is curve back towards the drive frame 14 through an angle of about 90°. This extension 22' serves as a guide for an additional carrier 78 which is connected to the plough base 25 via a shear-resistant and tension-proof chain (not shown) which is housed and guided within the extension 22'. This additional feature is particularly useful in the initial clearance of a "stable-hole."

It will be apparent that each of the auxiliary ploughs described above has the advantages of having its own drive unit, of being of a fairly simple and robust construction, and of sufficiently small width as not to occupy too much space in a "stable-hole" region. Moreover, because their carriers are arranged to pivot away from the coal face during the return stroke of the auxiliary ploughs, there is no danger of them fouling against detached coal that has not been loaded onto the main conveyor.

We claim:

1. A mineral mining installation for winning material in a "stable-hole" region of a longwall face, the installation comprising a guide, a base slidably mounted on the guide, at least one tool carrier pivotally mounted on the base, lost reciprocating motion linkage affixed to each tool carrier, drive means engaging the lost reciprocating motion linkage for reciprocating the base along the guide and for pivoting each carrier between an operating position and a non-operating position, the drive means having a working stroke which initially pivots each carrier from its non-operating position to its operating position and then causes the base and carrier(s) to execute a working stroke along the guide, and the driving means having a return stroke which initially causes each carrier to pivot from its operating position to its non-operating position and then causes the base and carrier(s) to execute a return stroke along the guide.

2. An installation according to claim 1, wherein a double-acting hydraulic ram constitutes the drive means.

3. An installation according to claim 1, wherein the working stroke of the drive means is directed towards the centre of the longwall face.

4. An installation according to claim 1, wherein there are a plurality of carriers which are coupled together for conjoint movement between their operating and non-operating positions.

5. An installation according to claim 1, wherein each carrier is provided with a lever drivably connected to the drive means, each carrier defining two stop faces which co-operate with a respective stop member on the base to constitute the lose of reciprocating motion linkage, the lose of reciprocating motion linkage being such that the initial movement of the drive means in either direction causes pivoting of each carrier and, when each carrier has been pivoted from a position in which one of its stop faces bears against the corresponding base stop member to a position in which the other of its stop faces bears against said stop member, further movement of the drive means carries the base and carrier(s) therewith..

6. An installation according to claim 1, further comprising a retarding device for retarding the pivotal movement of each carrier from its operating position to its non-operating position at the start of each return stroke.

7. An installation according to claim 6, wherein a hydraulic damping ram, interposed between the base and a carrier, constitutes the retarding device.

8. An installation according to claim 1, wherein the guide is provided with a curved extension along which an additional tool carrier is movable, the additional tool carrier being drivably linked to the base.

9. An installation according to claim 8, wherein the extension curves through an angle of approximately 90°.

10. An installation according to claim 1, wherein the lose of reciprocating motion linkage is constituted by an actuating lever movable with the drive means and stop means associated with the base, the lose of reciprocating motion linkage being such that the initial movement of the drive means in either direction causes pivoting of each carrier, and, when the actuating lever

11. An installation according to claim 10, wherein a pair of axially spaced stop faces constitute said stop means, the actuating lever being movable between said stop faces.

12. An installation according to claim 11, wherein there are three carriers and the actuating lever forms an extension of the central carrier.

13. An installation according to claim 11, wherein said stop faces are constituted by the ends of an elongate slot formed in a bracket carried by the base, and said actuating lever is constituted by a bolt carried by a bracket movable with the drive means.

14. An installation according to claim 13, further comprising a rod fixed to the actuating lever, the rod constituting the means for pivoting each carrier.

15. An installation according to claim 14, wherein a respective aperture is provided in the rod for each carrier, a lever fixed to that carrier extending into that aperture for transmitting rectilinear motion of the rod into pivotal motion of that carrier.

16. A mineral mining apparatus comprising a longwall conveyor, a plough reciprocable along the conveyor, a drive station at one end of the conveyor, and a mineral mining installation mounted on the drive frame of the drive station, the mineral mining installation comprising a guide, a base slidably mounted on the guide, at least one tool carrier pivotally mounted on the base, a lost reciprocating motion linkage affixed to each tool carrier, drive means engaging the reciprocating motion linkage for reciprocating the base along the guide and for pivoting each carrier between an operating position and a non-operating position, the drive means having a working stroke which initially pivots each carrier from its non-operating position to its operating position and then causes the base and the carrier(s) to execute a working stroke along the guide, and the driving means having a return stroke which initially causes each carrier to pivot from its operating position to its non-operating position and then causes the base and carrier(s) to execute a return stroke along the guide.

17. Apparatus according to claim 16, wherein the installation is movable relative to the drive frame.

18. Apparatus according to claim 17, wherein the installation is pivotably mounted to the drive frame whereby the installation can be pivoted relative to the drive frame to vary the angle its guide makes with the longitudinal axis of the conveyor.

19. Apparatus according to claim 17, wherein the installation is movable bodily towards and away from the longwall face.

20. A mineral mining apparatus comprising a longwall conveyor, a plough reciprocable along the conveyor, a drive station at each end of the conveyor, and two mineral mining installations each mounted on the drive frame of a respective drive station, each mineral mining installation comprising a guide, a base slidably mounted on the guide, at least one tool carrier pivotally mounted on the base, lost reciprocating motion linkage affixed to each tool carrier, drive means engaging the lost reciprocating motion linkage for reciprocating the base along the guide and for pivoting each carrier between an operating position and a non-operating position, the drive means having a working stroke which initially pivots each carrier from its non-operating to its operating position and then causes the base and carrier(s) to execute a working stroke along the guide, and the driving means having a return stroke which initially causes each carrier to pivot from its operating position to its non-operating position and then causes the base and carrier(s) to execute a return stroke along the guide.

21. Apparatus according to claim 20, wherein each installation is movable relative to its drive frame.

22. Apparatus according to claim 21, wherein each installation is pivotably mounted to its drive frame whereby that installation can be pivoted relative to that drive frame to vary the angle its guide makes with the longitudinal axis of the conveyor.

23. Apparatus according to claim 21, wherein each installation is movable bodily towards and away from the longwall face.

24. In a mineral mining installation for winning material in a "stable-hole" region of a longwall face, the installation comprising a guide, a base slidably mounted on the guide, at least one tool carrier pivotally mounted on the base, a lost reciprocating motion linkage affixed to each tool carrier, drive means engaging the lost reciprocating motion linkage for reciprocating the base along the guide, the improvement comprising the drive means also pivoting each carrier between an operating position and a non-operating position, the initial movement of the drive means in either direction causing pivoting of each carrier from one of said positions to the other, and then causing the base and carrier(s) to move along the guide.

* * * * *